US010914185B2

(12) United States Patent
Bonacum et al.

(10) Patent No.: US 10,914,185 B2
(45) Date of Patent: Feb. 9, 2021

(54) ADDITIVE MANUFACTURED CASE WITH INTERNAL PASSAGES FOR ACTIVE CLEARANCE CONTROL

(71) Applicant: GENERAL ELECTRIC COMPANY, Schenectady, NY (US)

(72) Inventors: Michael Robert Bonacum, Malden, MA (US); Thomas D. Martyn, Marblehead, MA (US); James R. Noel, Beverly, MA (US); Robert J. Parks, Ipswich, MA (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 644 days.

(21) Appl. No.: 15/368,227

(22) Filed: Dec. 2, 2016

(65) Prior Publication Data

US 2018/0156056 A1 Jun. 7, 2018

(51) Int. Cl.
*F01D 11/02* (2006.01)
*F01D 25/26* (2006.01)
(Continued)

(52) U.S. Cl.
CPC ..... *F01D 11/025* (2013.01); *F01D 9/065* (2013.01); *F01D 17/12* (2013.01); *F01D 25/243* (2013.01); *F01D 25/26* (2013.01); *F05D 2220/32* (2013.01)

(58) Field of Classification Search
CPC ..... F01D 11/025; F01D 9/065; F01D 17/12; F01D 25/243; F01D 25/26; F05D 2220/32
(Continued)

(56) References Cited

U.S. PATENT DOCUMENTS 4,513,567 A * 4/1985 Deveau ..... F01D 11/08 415/178
4,525,998 A * 7/1985 Schwarz ..... F01D 25/145 60/226.1
(Continued)

FOREIGN PATENT DOCUMENTS

JP 2012/072708 A 4/2012
WO WO-2015/069145 A1 5/2015
WO WO2016/050575 A1 4/2016

OTHER PUBLICATIONS

PCT International Search Report Corresponding to Application No. PCT-US2017060014 dated Jun. 13, 2019.

*Primary Examiner* — Logan M Kraft
*Assistant Examiner* — John D Bailey
(74) *Attorney, Agent, or Firm* — Dority & Manning, P.A.

(57) ABSTRACT

An engine or engine casing having an inner annular case and an outer annular case. The engine casing is formed using an additive manufacturing technique such that the inner annular case and outer annular case is formed surrounding a hollow inner annular cavity. The annular cavity includes a pin bank connecting the inner annular case and outer annular case. The pin bank improves heat transfer between the inner and outer annular case and provide structural support to the inner and outer annular case. By providing fluid flow through the annular cavity, the turbine casing can be cooled and the radius of the casing can be controlled through the regulation of fluid travelling within the annular cavity. By controlling the fluid flow though the annular cavity, the engine case may be cooled to regulate its temperature in a wide variety of operating conditions. Further, the regulation of fluid in the annular cavity allows for active clearance control of the spacing between the turbine blades or vanes and seals used in the turbine.

17 Claims, 4 Drawing Sheets

(51) Int. Cl.
*F01D 25/24* (2006.01)
*F01D 9/06* (2006.01)
*F01D 17/12* (2006.01)

(58) Field of Classification Search
USPC ..... 415/178
See application file for complete search history.

(56) References Cited

U.S. PATENT DOCUMENTS 4,856,272 A * 8/1989 Putman ..... F01D 11/24 60/782
5,012,420 A 4/1991 Walker et al.
5,100,291 A * 3/1992 Glover ..... F01D 11/24 165/169
5,205,115 A * 4/1993 Plemmons ..... F01D 11/24 60/806
5,772,397 A * 6/1998 Morris ..... F01D 5/187 415/115
5,899,660 A 5/1999 Dodd
6,817,189 B2 11/2004 Boeck
7,597,537 B2 * 10/2009 Bucaro ..... F01D 11/24 415/136
8,092,146 B2 * 1/2012 Legare ..... F01D 25/12 415/1
8,162,593 B2 4/2012 Guimbard et al.
8,371,127 B2 2/2013 Durocher et al.
8,434,997 B2 * 5/2013 Pinero ..... F01D 25/26 415/115
9,079,803 B2 7/2015 Xu
9,157,331 B2 * 10/2015 Laurello ..... F01D 11/24
9,957,895 B2 * 5/2018 Suciu ..... F01D 25/24
10,087,772 B2 * 10/2018 Sun ..... F04D 29/526
2006/0026833 A1 * 2/2006 Imbourg ..... F01D 25/14 29/890.01
2006/0225430 A1 10/2006 Paprotna et al.
2007/0086887 A1 * 4/2007 Pezzetti, Jr. ..... F01D 11/24 415/173.1
2008/0112798 A1 * 5/2008 Seitzer ..... F01D 11/24 415/144
2009/0297342 A1 * 12/2009 Laborie ..... F02C 7/28 415/177
2010/0247297 A1 * 9/2010 Legare ..... F02K 3/02 415/173.1
2011/0085900 A1 4/2011 Schutz
2011/0138819 A1 * 6/2011 Tanimura ..... F01D 25/30 60/796
2012/0003086 A1 * 1/2012 Morris ..... F01D 9/041 415/200
2013/0149123 A1 * 6/2013 Laurello ..... F01D 11/24 415/191
2013/0283762 A1 * 10/2013 Simpson ..... F16K 31/16 60/39.23
2013/0302154 A1 11/2013 Finlayson
2014/0093387 A1 * 4/2014 Pointon ..... B22C 7/02 416/97 R
2014/0112757 A1 * 4/2014 Bacic ..... F01D 11/24 415/110
2014/0161601 A1 6/2014 Geiger
2014/0216042 A1 * 8/2014 Hanson ..... F23R 3/002 60/754
2014/0241854 A1 * 8/2014 Gekht ..... F01D 11/24 415/60
2015/0337675 A1 * 11/2015 Suciu ..... F01D 17/00 60/805
2016/0003071 A1 * 1/2016 Ghigliotty ..... F01D 9/041 415/115
2016/0010555 A1 * 1/2016 Suciu ..... F01D 5/02 60/772
2016/0084089 A1 * 3/2016 Blaney ..... F04D 29/542 415/115
2016/0115820 A1 * 4/2016 Prentice ..... F01D 5/147 415/200
2016/0123230 A1 * 5/2016 Thomas ..... F02C 7/185 60/772
2016/0138471 A1 * 5/2016 Van Der Woude ..... F02K 3/115 415/144
2016/0151829 A1 * 6/2016 Propheter-Hinckley ..... F01D 5/284 164/529
2016/0186606 A1 * 6/2016 Blaney ..... F04D 29/584 415/116
2016/0348526 A1 * 12/2016 Vetters ..... F01D 25/246
2017/0074112 A1 * 3/2017 Philbrick ..... F01D 11/22
2017/0089264 A1 * 3/2017 Jones ..... F01D 25/12
2017/0175769 A1 * 6/2017 Sun ..... F01D 11/24
2017/0204737 A1 * 7/2017 Varney ..... F01D 11/005
2017/0204744 A1 * 7/2017 Varney ..... F01D 25/246
2017/0268535 A1 * 9/2017 Mondal ..... F04D 29/642
2017/0292389 A1 10/2017 Lorstad et al.
2017/0306765 A1 * 10/2017 Walunj ..... F01D 5/147
2018/0073435 A1 * 3/2018 Chen ..... F02C 7/24
2018/0135461 A1 * 5/2018 Petkova ..... F02C 7/266
2019/0024520 A1 * 1/2019 Underwood ..... F01D 9/041

* cited by examiner

PRIOR ART

ADDITIVE MANUFACTURED CASE WITH INTERNAL PASSAGES FOR ACTIVE CLEARANCE CONTROL

INTRODUCTION

The disclosure relates to improved designs for engine components that include at least one internal fluid annular passage formed in a sandwich structure within an engine casing. The disclosure provides structure optimized to provide for one or more of the following characteristics: structural integrity, thermo-mechanical load carrying capability, buckling, containment, cooling and/or temperature control, flow pressure drop, improved temperature gradient and finally improved life of component.

BACKGROUND

Gas turbine engines generally include at least one compressor and at least one turbine section each having rotating blades contained within an engine housing. One of the goals in designing an engine housing is to maintain a lightweight structure while still providing enough strength to contain any rotating blade that may break (i.e. blade containment). Because any broken blades must be contained within the housing, the walls of engine housings must be manufactured to ensure broken blades do not puncture the housing. Proposals to reduce weight and strengthen the turbine case have relied on additive manufacturing techniques to prepare a sandwich structure for the case with an intermediate layer that is a porous structure and/or honeycomb structure. See U.S. Pat. Appl'n. Pub. No. 2014/0161601. These designs provide an internal porous or honeycomb structure between the inner and outer walls of an engine casing, which is designed to increase strength while reducing the weight of the engine casing. These designs primarily rely on external piping to cool the composite engine casing.

Turbine engines may also incorporate active clearance control (ACC) to help maintain proper temperature of the engine casing and provide proper rotor/case clearance during a range of operating conditions and parameters. For Example, ACC may be used to control the case diameter to increase and conform to expected blade growth or decrease in diameter for blade contraction under various engine operating conditions. Impingement cooling is frequently employed in ACC systems to control the temperature of the engine casing. Impingement cooling generally relies on the formation of a boundary layer on the surface of the component, for example. Frequently in an ACC system, an external pipe arrangement may be employed to supply cooler air to the surfaces of the engine case. As shown in FIG. 1, external pipes 101 may supply cooling air to the outside of the engine case. As shown in FIG. 2, the external cooling pipes 101 may direct air from a manifold 102 to help maintain proper temperature of the engine casing and provide proper rotor/case clearance during operation. The complexity of the external piping 101, 102 and ancillary piping tubes, brackets and valve, may increase manufacturing costs and may increase the engine's weight. A need exists for an engine case having lower weight, increased strength, increased cooling and temperature control effectiveness.

SUMMARY OF THE INVENTION

Through the use of additive manufacturing techniques, an engine casing may be formed having an internal cooling circuit. The internal cooling circuit, may be used, along with other benefits, to control the temperature of the engine case and/or deliver required cavity purge air. Through control of the engine case temperature using the internal cooling circuit, ACC control may be possible without the additional weight and complexity of an external ACC system. Additional advantages and novel features of these aspects will be set forth in part in the description that follows, and in part will become more apparent to those skilled in the art upon examination of the following or upon learning by practice of the disclosure.

BRIEF DESCRIPTION OF THE DRAWINGS

The accompanying drawings, which are incorporated into and constitute a part of this specification, illustrate one or more example aspects of the present disclosure and, together with the detailed description, serve to explain their principles and implementations.

DETAILED DESCRIPTION

Figure 1:
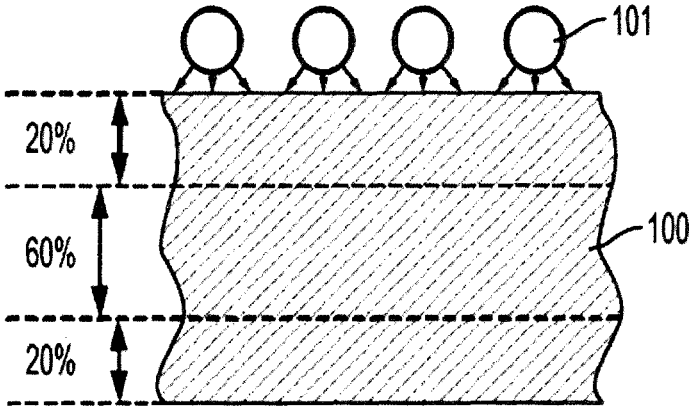
FIG. 1 Prior Art
FIG. 1 is a cross-section view depicting a conventional turbine engine case.
Figure 2:
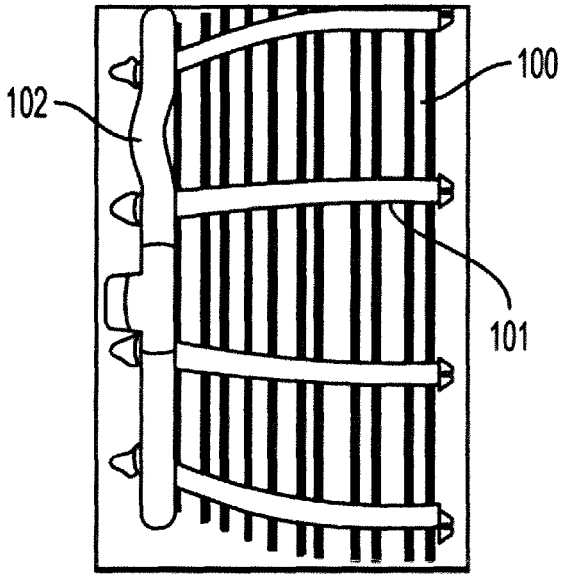
FIG. 2 Prior Art
FIG. 2 is a side-view depicting a conventional turbine case.

Typically, turbine includes a compressor portion, a combustion portion, and a turbine portion. The turbine portion may include a gas generator turbine (GT) and a power turbine (PT). While the majority of the description below describes the power turbine (PT) portion of a turbine, the present invention is applicable to the compressor portion of the turbine as well. The following detailed description sets forth an internal annular cavity for providing temperature control to a power turbine (PT) by way of example and not by way of limitation. For example, the disclosed aspects may be implemented in other engine parts for case cooling and/or temperature control for other parts such as a high pressure turbine (HPT) or low pressure turbine (LPT), the high pressure compressor (HPC) or low pressure compressor (LPC), turbine center frame (TCF), and combustor, for example. The description should clearly enable one of ordinary skill in the art to make and use the internal annular cavity, and the description sets forth several aspects, adaptations, variations, alternatives, and uses of the internal passage, by way of example. The internal fluid cavity described herein as being applied to a few preferred aspects, namely to different embodiments of the internal cooling passages for an PT engine case. However, it is contemplated that the internal cooling passages and method of fabricating the internal annular cavity may have general application in a broad range of systems and/or a variety of commercial, industrial, and/or consumer applications other than the internal temperature control for a PT case of a turbine engine.

The turbine casing 200 may comprise a series of casing rings that are joined to form a single casing defining an inner chamber surrounding the turbine assembly, or the turbine casing may be comprised of a single uninterrupted structure forming a chamber. The power turbine may include an array of stator vanes 18, which may be attached at a radially outward end to the inner part of the turbine casing. The stator vanes 18 may be either formed as a single structure with the turbine casing 200 or may be attached to the casing using bolts or studs (not shown). Sealing portions 228 may be attached to the casing 200 through brazing, may be press fit, may be attached using fasteners commonly known and used in the art, and/or may include a single or plurality of attachment portions 231 that fit into corresponding attachment portion receiving sections 230 on the casing 200. Each blade 212 may include at least one tip shroud 214 to improve clearance between the sealing portion 228 and the blade 212 and/or to suppress resonant vibration. During operation, the turbine blades 212 and/or stator vanes 18 may experience growth or contraction due to thermal effects on the metals and/or may experience due to rotational forces. As an example, any space between blades 212 and sealing portions 228 results in a leakage of gasses, and accordingly, a loss in energy. Further, an increase in the abovementioned clearance allows more bypass flow around the blade tips and seals which may also introduce a mixing loss when it re-enters the flow path at a location 240 of the chamber downstream of the seal. If too little space is maintained between the blades 212 and the sealing portion 228 contact and binding may occur during operation. Accordingly, clearance between blades of the turbine and the seals and/or casing may have a strong impact on performance. Several example explanations of the changes in part dimensions in a turbine due to various operating conditions, and parameters for controlling the temperature of the casing to correspond to the abovementioned conditions are explained in U.S. Pat. No. 5,012,420 A, which is hereby incorporated by reference.

The turbine casing may be manufactured using an additive manufacturing (AM) technique, which may include selective laser sintering (SLS), direct metal laser sintering (DMLS) and three dimensional printing (3DP). Any of the above additive manufacturing techniques may be used to form the turbine casing from stainless steel, aluminum, titanium, Inconel 625, Inconel 718, cobalt chrome, among other metal materials or any alloy thereof. In each of the abovementioned additive manufacturing techniques powder based fabrication methods, powdered material may be melted or sintered to form each part layer. For example, the additive manufacture of large parts having integrated cooling can be accomplished using an apparatus and method such as described below.

Figure 5:
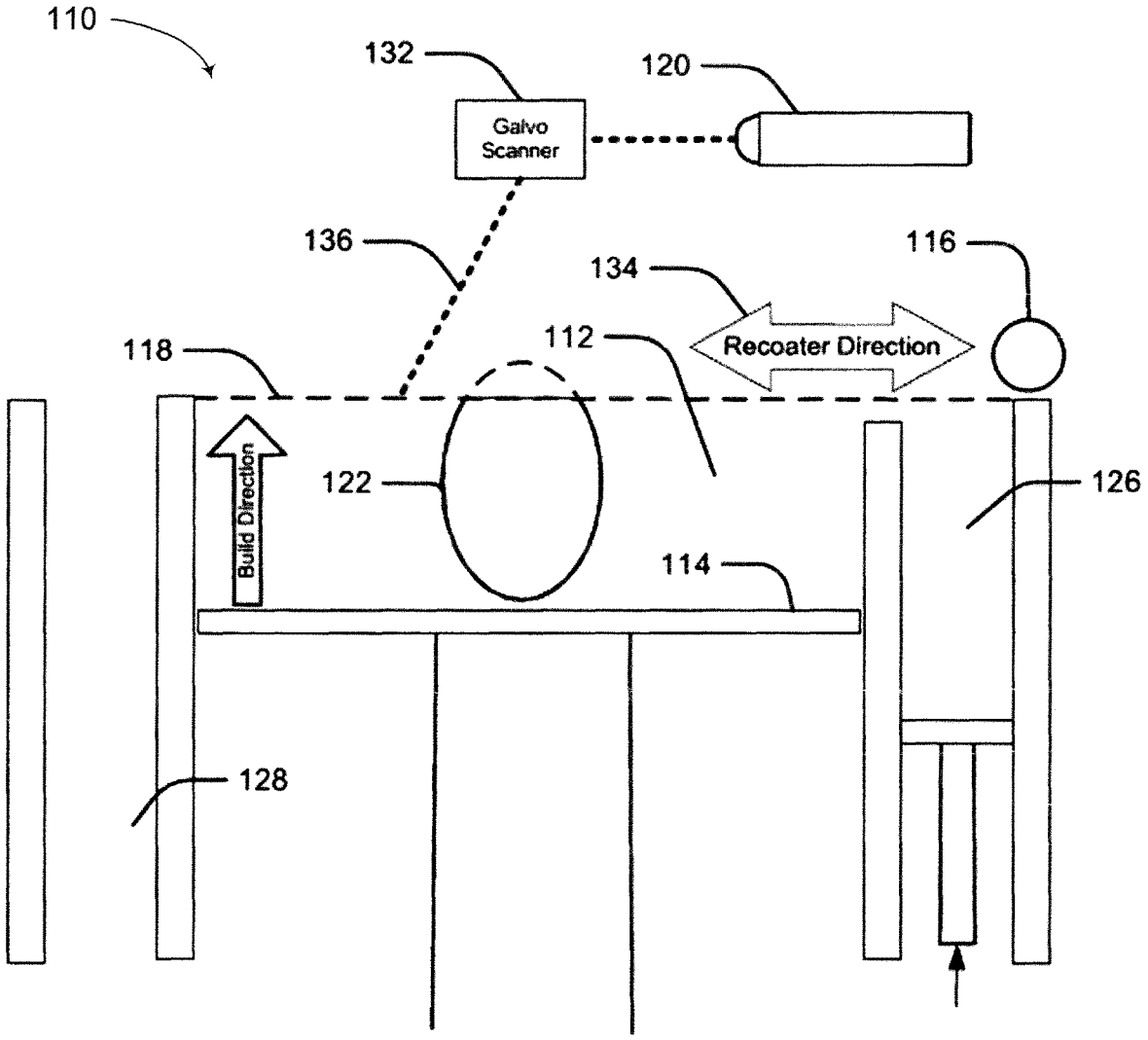
FIG. 5 is schematic diagram showing an example of a conventional apparatus for additive manufacturing.

FIG. 5 is schematic diagram showing a cross-sectional view of an exemplary conventional system 110 for direct metal laser sintering (DMLS) or direct metal laser melting (DMLM). The apparatus 110 builds objects, for example, the part 122, in a layer-by-layer manner by sintering or melting a powder material (not shown) using an energy beam 136 generated by a source such as a laser 120. The powder to be melted by the energy beam is supplied by reservoir 126 and spread evenly over a build plate 114 using a recoater arm 116 travelling in direction 134 to maintain the powder at a level 118 and remove excess powder material extending above the powder level 118 to waste container 128. The energy beam 136 sinters or melts a cross sectional layer of the object being built under control of the galvo scanner 132. The build plate 114 is lowered and another layer of powder is spread over the build plate and object being built, followed by successive melting/sintering of the powder by the laser 120. The process is repeated until the part 122 is completely built up from the melted/sintered powder material. The laser 120 may be controlled by a computer system including a processor and a memory. The computer system may determine a scan pattern for each layer and control laser 120 to irradiate the powder material according to the scan pattern. After fabrication of the part 122 is complete, various post-processing procedures may be applied to the part 122. Post processing procedures include removal of access powder by, for example, blowing or vacuuming. Other post processing procedures include a stress release process. Additionally, thermal and chemical post processing procedures can be used to finish the part 122.

The apparatus 110 is controlled by a computer executing a control program. For example, the apparatus 110 includes a processor (e.g., a microprocessor) executing firmware, an operating system, or other software that provides an interface between the apparatus 110 and an operator. The computer receives, as input, a three dimensional model of the object to be formed. For example, the three dimensional model is generated using a computer aided design (CAD) program. The computer analyzes the model and proposes a tool path for each object within the model. The operator may define or adjust various parameters of the scan pattern such as power, speed, and spacing, but generally does not program the tool path directly.

In one aspect, the active clearance control (ACC) flow 250 may be routed in between two layers, which may comprise an annular outer layer 200 and an inner annular layer 226 and flow cavity 225 through which fluid may flow between the two layers. The annular outer layer 200 and inner layer 226 having an inner wall 211 may be connected through the flow cavity 225 by an internal lattice structure (not shown) or a pin bank comprising a plurality of pins 220 connecting the annular outer layer 200 and the inner annular layer 226. Any of the above additive manufacturing techniques may be utilized to form the annular outer layer, the annular inner layer and the pin bank as a single uninterrupted structure. The pin bank may include a series of pin banks. The pin banks may further be connected to the outer annular layer 200 and inner annular layer 226 to maintain a heat conduction path for outer and/or inner case cooling and/or to control the clearance between the turbine blades 212 and seal portions 228 and/or to control the clearance between the stator vanes 210 and the stator seal (not shown). The pin banks be dimensioned and arranged to further promote heat transfer and allow for impingement cooling of the outer annular layer to cool the inner annular layer. The pin banks may further be arranged to carry any required structural loads between the outer and inner layer.

Figure 4:
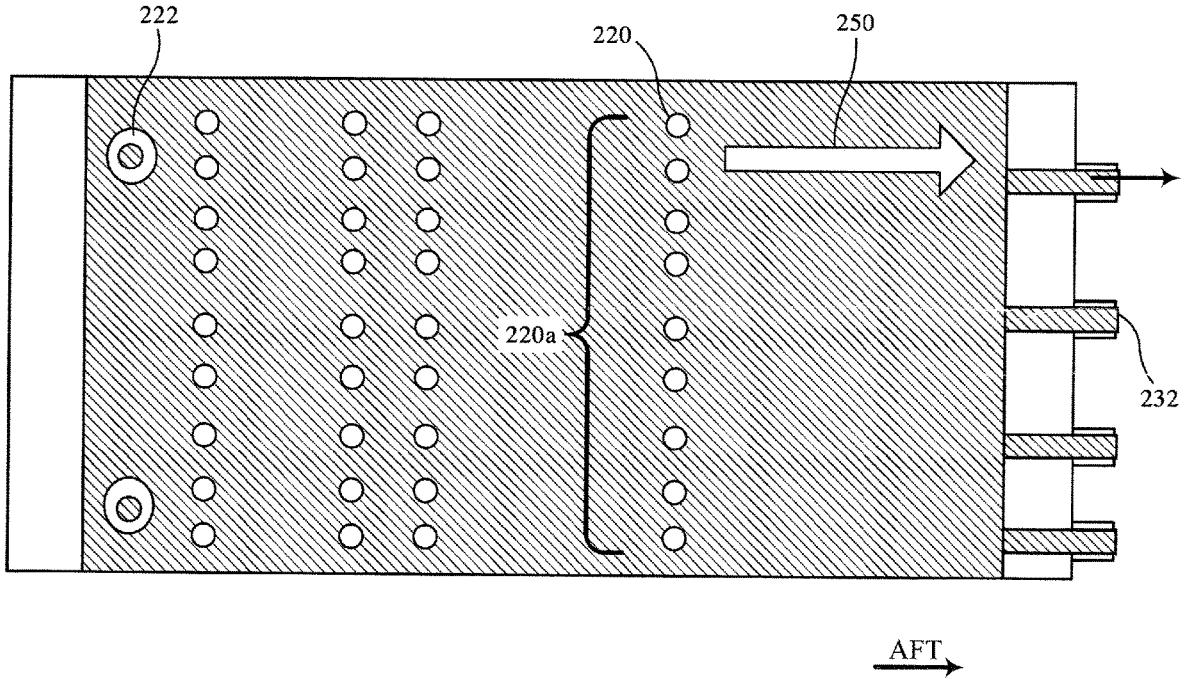
FIG. 4 is a cut-away view of the cooling passage internal to the engine case of FIGS. 3A and/or 3B in accordance with one aspect of the disclosure.

In one aspect, the pins 220 connect the outer annular layer 200 and the inner annular layer 226 at a portion of the inner annular layer where the vanes 212 and/or seal portions 228 are mounted, such an arrangement of the pins 220 may ensure any external case impingement cooling remains effective in the event that ACC system is turned off or is not functioning. As shown in FIG. 4, a pin bank 220A may be located above the mounting points of the vanes 212 and/or seals 228, for example. The pin banks may further be optimized in shape and/or arrangement to function as turbulation features to optimize cooling and/or heat conduction between the inner and outer layers 200 and 226. Further, the flow cavity 225 may include turbulation features separate from the pins 220, the turbulation features may connect the inner annular layer 226 and the outer annular layer 200 through the flow cavity 225 and/or may be located on a surface of the inner and/or outer annular layer facing the inside the flow cavity 225. The flow cavity 225 may also include an inner serpentine flow path to further improve and/or control the effectiveness of heat transfer.

Figure 3A:
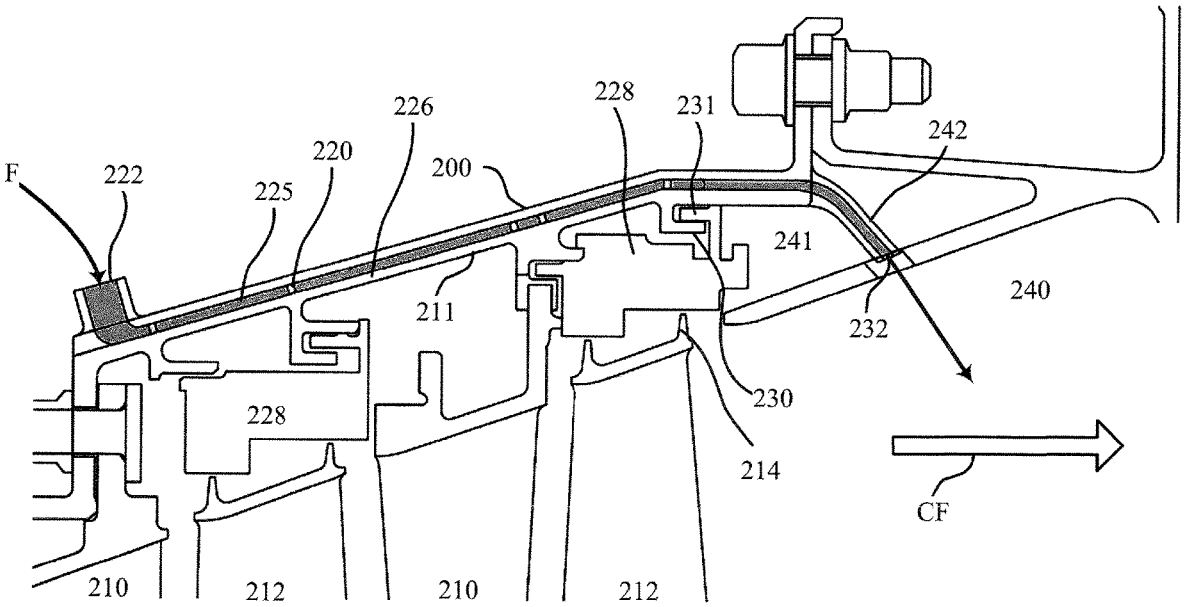
FIG. 3A is a cross-sectional view depicting an engine case having an internal cooling passage in accordance with one aspect of the disclosure.
Figure 3B:
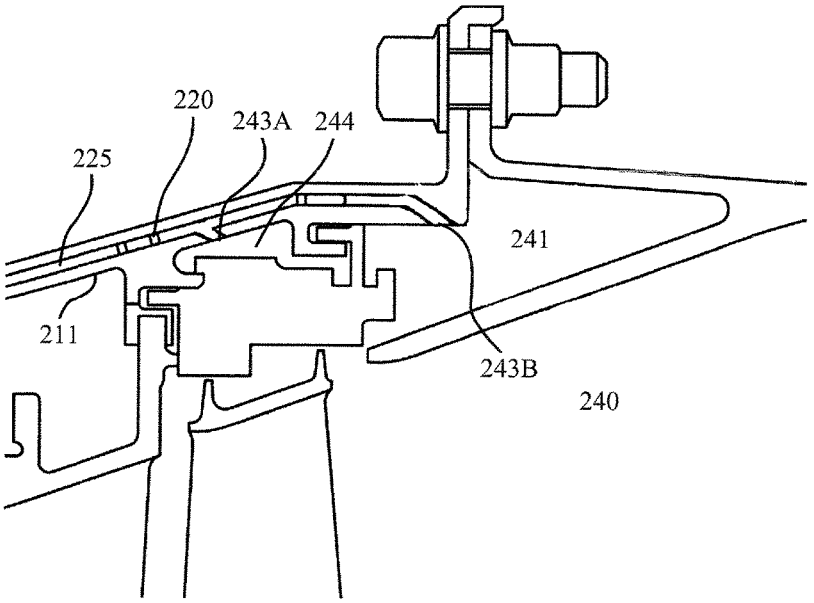
FIG. 3B is a cross-sectional view depicting an engine casing having an internal cooling passage in accordance with one aspect of the disclosure.

Allowing controlled flow of fluid to travel between the outer layer 200 and inner layer 226 in the flow cavity 225 allows for replacing at least a portion of an existing solid case with external ACC pipe arrangement with the abovementioned case having multiple layers. In one aspect, the external pipes used to cool the solid case in a LPT engine are partially or entirely replaced through the use of internal annular cavity 225 in the case. In one arrangement, the ACC fluid flow may be combined with higher pressure air from the secondary air system (SAS) in order to achieve the cooling and clearance objectives of the system. The particular coolant path and pin bank, turbulation features, and/or serpentine flow path structure may be designed to account for the pressure drop in the system and to optimize the SAS. As shown in FIG. 3B, in one aspect the inner annular layer 226 may have at least one outlet 243A and/or 243B in fluid communication with at least portions of the inside of the turbine casing 241 and/or 244 and the flow cavity 225 to allow for cavity purge flow. Further, the abovementioned outlets 243A and/or 243B may be used in conjunction with the ejector 242 and outlet 232 shown in FIG. 3A.

The air inlet 222 may be connected to at least one valve (not shown) which may be connected to a bay air source or other auxiliary fluid source. The valve may be a modulation valve connected to a single air source (e.g. bay air) to control the flow of fluid and/or the temperature of the fluid in the flow cavity based on various detected operating parameters and the flow rate and temperature of the fluid, and heat transfer from the materials known to cause an optimal clearance between the inner annular layer 226 of the case and the vanes 220 and/or blades 212. The valve may also comprise at least one modulating and at least one mixing valve, that may vary the proportions of fluid from multiple sources. Further, in one aspect, the upstream cavity opening may be open to a bay air source and/or the valve may default to or remain open when an the ACC system is not in use or in case the ACC system fails; the ejection flow path through outlet 232 in fluid communication with the flow cavity and the PT cause a positive flow (e.g. from the upstream air inlet 222 to the downstream ejection flow path outlet 232) to assure that fluid flows through the flow cavity at all times to provide for proper cooling of the PT case. The downstream outlet 232 may include at least one ejector 242. The ejectors may have an exit in the main air stream flow path CF, which may create a pressure differential due to a venturi effect. The pressure differential may ensure a positive pressure gradient always exists across the flow cavity. The ejector 242 may also be a trumpet shaped ejector. The abovementioned ejectors 242 may be formed by any one of the abovementioned additive manufacturing techniques and may be installed separately on at least one of the outlet 232 or may be formed as a unitary structure with at least one of the outlet 232 though the abovementioned additive manufacturing techniques, for example.

Through the abovementioned control of the fluid traveling in the flow cavity 225 the temperature of inner annular layer 226 may be raised or lowered by up to 100.degree. By raising or lowering the temperature of the inner annular layer 226, proper clearances between the tip shrouds 214 and seal portions 228 and/or the stator vanes 210 and stator seals (not shown) may be maintained. The abovementioned control of proper clearances may be especially advantageous for rotorcraft capable of flight speeds greater than 200 knots.

While the aspects described herein have been described in conjunction with the example aspects outlined above, various alternatives, modifications, variations, improvements, and/or substantial equivalents, whether known or that are or may be presently unforeseen, may become apparent to those having at least ordinary skill in the art. Accordingly, the example aspects, as set forth above, are intended to be illustrative, not limiting. Various changes may be made without departing from the spirit and scope of the disclosure. Therefore, the disclosure is intended to embrace all known or later-developed alternatives, modifications, variations, improvements, and/or substantial equivalents.

What is claimed is:

1. A turbine engine comprising:

an annular inner wall surrounding a turbine assembly, the turbine assembly rotating around a first axis;

an annular outer wall at least partially surrounding the annular inner wall and forming an annular cavity between the annular inner wall and the annular outer wall;

wherein the annular outer wall has at least one upstream opening at an axially forward position on the first axis in fluid communication with the annular cavity and the annular cavity has an outlet at an axially aft position on the first axis allowing fluid to pass from the upstream opening along the annular cavity through the outlet; and a plurality of pins disposed between, integrally formed with, and connecting the annular inner wall and the annular outer wall, wherein the plurality of pins comprise a pin bank.

2. The engine of claim 1 further comprising a valve connected to at least one of the upstream opening and the outlet for controlling fluid flow in the annular cavity.

3. The engine of claim 1, wherein fluid passes along the annular cavity due to a pressure difference between the upstream opening and the outlet.

4. The engine of claim 1, further comprising at least one opening in the inner wall between the upstream opening and the outlet.

5. The engine of claim 1, wherein the outlet comprises at least one ejector.

6. The engine of claim 1, wherein the inner wall further comprises at least one auxiliary opening between said upstream opening and said outlet, wherein the at least one auxiliary opening allows fluid to pass into a chamber formed by the inner wall and one or more of a sealing portion or stator vane.

7. The engine of claim 2, wherein the annular inner wall has a plurality of sealing portions mounted thereto;

wherein the plurality of sealing portions correspond to a plurality of turbine blades of the turbine assembly;

wherein the valve controls a fluid flow into the annular cavity, and the valve is controlled in response to the thermal expansion characteristics of the inner and outer wall so as to keep the distance between the sealing portions and the turbine blades substantially constant.

8. A turbine engine casing comprising:

an annular inner wall, the annular inner wall having at least one stator attachment portion for attaching at least one stator vane, and at least one seal attachment portion for attaching a seal;

an annular outer wall at least partially surrounding the annular inner wall and forming an annular cavity between the annular inner wall and the annular outer wall;

wherein the annular outer wall has at least one fluid inlet to the annular cavity and the annular cavity has at least one fluid outlet allowing fluid to pass from the upstream opening along the annular cavity through the outlet; and a plurality of pins disposed between and connecting the annular inner wall and the annular outer wall, wherein the plurality of pins are integrally formed with and connect the annular inner wall and the annular outer wall at a portion of the annular inner wall where the seal is mounted, wherein fluid passes along the annular cavity due to a pressure difference between the upstream opening and the outlet, and wherein the plurality of pins comprise a pin bank.

9. The engine of claim 8 further comprising a valve connected to at least one of the fluid inlet and the outlet for controlling fluid flow in the annular cavity.

10. The engine of claim 8, further comprising at least one opening in the inner wall between the inlet and the outlet.

11. The engine of claim 8, wherein the outlet comprises at least one ejector.

12. A method of forming an engine casing using an additive manufacturing technique, the method comprising:

(a) irradiating a layer of powder with an energy beam in a series of scan lines to form a fused region;

(b) providing a subsequent layer of powder; and (c) repeating steps (a) and (b) until the engine casing is formed, the engine casing comprising:

an annular inner wall, the annular inner wall having at least one stator attachment portion for attaching at least one stator vane, and at least one seal attachment portion for attaching a seal;

an annular outer wall at least partially surrounding the annular inner wall and forming an annular cavity between the annular inner wall and the annular outer wall;

wherein the annular outer wall has at least one fluid inlet to the annular cavity and the annular cavity has at least one fluid outlet allowing fluid to pass from the upstream opening along the annular cavity through the outlet; and a plurality of pins disposed between and connecting the annular inner wall and the annular outer wall, wherein the plurality of pins are integrally formed with and connect the annular inner wall and the annular outer wall at a portion of the annular inner wall where the seal is mounted, wherein the plurality of pins comprise a pin bank.

13. The method of claim 12 further comprising forming a valve connected to at least one of the fluid inlet and the outlet for controlling fluid flow in the annular cavity.

14. The method of claim 12, wherein fluid passes along the annular cavity due to a pressure difference between the upstream opening and the outlet.

15. The method of claim 12, further comprising forming at least one opening in the inner wall between the inlet and the outlet.

16. The method of claim 12, wherein the outlet comprises at least one ejector.

17. The engine of claim 7, wherein the plurality of pins respectively connect the annular inner wall and the annular outer wall at a portion of the annular inner wall where the sealing portions are mounted.

* * * * *